US011885535B2

(12) United States Patent
Koester et al.

(10) Patent No.: US 11,885,535 B2
(45) Date of Patent: Jan. 30, 2024

(54) ETXV DIRECT DISCHARGE INJECTION COMPRESSOR

(71) Applicant: Hanon Systems, Daejeon (KR)

(72) Inventors: Steven Koester, Toledo, OH (US); Rod Callahan, Novi, MI (US); Brad Crenshaw, Riverview, MI (US)

(73) Assignee: HANON SYSTEMS, Daejeon (KR)

( * ) Notice: Subject to any disclaimer, the term of this patent is extended or adjusted under 35 U.S.C. 154(b) by 41 days.

(21) Appl. No.: 17/655,007

(22) Filed: Mar. 16, 2022

(65) Prior Publication Data

US 2022/0397316 A1 Dec. 15, 2022

Related U.S. Application Data

(60) Provisional application No. 63/209,729, filed on Jun. 11, 2021.

(51) Int. Cl.

| | |
|---|---|
| ***F25B 31/00*** | (2006.01) |
| ***F04C 18/02*** | (2006.01) |
| ***F04C 28/24*** | (2006.01) |
| ***F04B 49/22*** | (2006.01) |

(52) U.S. Cl.

CPC ..... *F25B 31/00* (2013.01); *F04B 49/225* (2013.01); *F04C 18/0207* (2013.01); *F04C 28/24* (2013.01); *F25B 31/008* (2013.01)

(58) Field of Classification Search

CPC .... F25B 31/00; F25B 31/008; F25B 2500/31; F04B 49/225; F04C 18/0207; F04C 28/24

See application file for complete search history.

(56) References Cited

U.S. PATENT DOCUMENTS

| | | | | |
|---|---|---|---|---|
| 6,773,242 | B1 | 8/2004 | Perevozchikov | |
| 11,002,272 | B2 | 5/2021 | Klotten et al. | |
| 11,022,119 | B2 * | 6/2021 | Perevozchikov | F04C 28/24 |
| 2004/0184932 | A1 * | 9/2004 | Lifson | F04C 29/042 417/310 |

(Continued)

FOREIGN PATENT DOCUMENTS

| | | | |
|---|---|---|---|
| EP | 0508293 | A1 | 10/1992 |
| JP | H0765573 | B2 | 7/1995 |

(Continued)

*Primary Examiner* — Henry T Crenshaw
*Assistant Examiner* — Kamran Tavakoldavani
(74) *Attorney, Agent, or Firm* — Shumaker, Loop & Kendrick, LLP; James D. Miller

(57) ABSTRACT

A compressor operable in a heat pump mode of a refrigerant circuit includes a compression space in which a refrigerant is compressed. The compression space includes a discharge port and an injection port. A discharge chamber is fluidly coupled to the compression space by the discharge port. An injection chamber is fluidly coupled to the compression space by the injection port. A discharge recirculation pathway selectively provides fluid communication between the discharge chamber and the injection chamber. An injection of the recirculated refrigerant into the compression space through the injection port results in an increase in pressure, and hence temperature, of the refrigerant when discharged to the discharge chamber. The increased temperature of the discharged refrigerant increases a heating capacity of a condenser of the associated refrigerant circuit.

20 Claims, 8 Drawing Sheets

(56) References Cited

U.S. PATENT DOCUMENTS

| | | | | |
|---|---|---|---|---|
| 2005/0039473 | A1* | 2/2005 | Pondicq-Cassou | F25B 47/022 62/196.4 |
| 2008/0078191 | A1* | 4/2008 | Morishita | F25B 1/04 62/126 |
| 2011/0179822 | A1* | 7/2011 | Sotojima | F04C 28/02 62/510 |
| 2013/0025311 | A1 | 1/2013 | Graaf et al. | |
| 2013/0283850 | A1* | 10/2013 | Delaforge | F25B 41/24 62/498 |
| 2021/0285445 | A1 | 9/2021 | Bhatia et al. | |

FOREIGN PATENT DOCUMENTS

| | | | |
|---|---|---|---|
| JP | H08313073 | A | 11/1996 |
| JP | 2001263846 | A | 9/2001 |
| JP | 2012127222 | A | 7/2012 |
| KR | 100724384 | B1 | 6/2007 |
| KR | 101738458 | B1 | 6/2017 |

* cited by examiner

ETXV DIRECT DISCHARGE INJECTION COMPRESSOR

CROSS-REFERENCE TO RELATED APPLICATION

This patent application claims priority to U.S. Provisional Patent Application Ser. No. 63/209,729, filed on Jun. 11, 2021, the entire disclosure of which is hereby incorporated herein by reference.

FIELD OF THE INVENTION

The invention relates to a thermal management system having a scroll compressor, and more particularly, to a thermal management system having a vapour injection scroll compressor with a discharge recirculation feature.

BACKGROUND OF THE INVENTION

A thermal management system for use in an electric vehicle may utilize a heat pump system in order to manage the temperature of various components of the electric vehicle and/or to heat or cool the air delivered to the passenger cabin of the vehicle. The heat pump system is circulated by a refrigerant and includes at least a compressor, a first heat exchanger acting as a condenser, an expansion element, and a second heat exchanger acting as an evaporator. The compressor of the system may be operated to increase the temperature of the refrigerant in order to supply heat to the downstream condenser, which is in turn placed in heat exchange relationship with air delivered to the passenger cabin. The heating capacity of the cabin condenser is therefore dependent on the temperature of the refrigerant entering the cabin condenser following compression within the compressor.

One disadvantage of this arrangement is encountered when the thermal management system encounters especially low ambient air temperatures requiring an increased heating capacity of the refrigerant within the cabin condenser in order to meet heating demands. That is, the air at the low ambient temperature may extract enough heat from the refrigerant within the cabin condenser to cause the total heating capacity of the thermal management system to be reduced to an undesirable extent. There is accordingly a need to provide additional heat to the refrigerant prior to introduction into the cabin condenser to account for such low temperature conditions.

One solution to the problem of increased heating demand within the cabin condenser includes the use of a vapor injection scroll compressor to further heat the refrigerant upstream of the cabin condenser. The vapor injection scroll compressor provides the advantage over a traditional scroll compressor by utilizing two different inputs of the refrigerant at different pressures and/or temperatures. Generally, a scroll compressor includes a fixed scroll that remains stationary and an orbiting scroll that is nested relative to the fixed scroll and configured to orbit relative to the fixed scroll. The orbiting motion of the orbiting scroll, as well as the similar spiral shape of each of the fixed scroll and the orbiting scroll, continuously forms corresponding pairs of substantially symmetric compression chambers between the fixed scroll and the orbiting scroll. Each pair of the compression chambers is typically symmetric about a centralized discharge port of the vapor injection scroll compressor. Refrigerant typically enters each of the compression chambers via one or more inlet ports formed adjacent a radially outmost portion of the fixed scroll and then the orbiting motion of the orbiting scroll relative to the fixed scroll results in each of the compression chambers progressively decreasing in volume such that the refrigerant disposed within each of the compression chambers progressively increases in pressure as the refrigerant approaches the radially central discharge port.

The vapor injection scroll compressor is distinguished from traditional scroll compressors by injecting the returned refrigerant into each of the compression chambers at a corresponding intermediate position disposed radially between the outwardly disposed inlet ports and the centrally disposed discharge port of the fixed scroll. The injected refrigerant accordingly enters each of the compression chambers at a position corresponding to a region of the fixed scroll repeatedly subjected to a pressure of the radially inwardly flowing refrigerant that is generally intermediate the suction pressure formed at the inlet ports and the discharge pressure formed at the discharge port of the fixed scroll. The injected refrigerant originates from an injection chamber of the vapor injection scroll compressor configured to receive the returned refrigerant therein prior to reintroduction back into the compression chambers.

The vapor injection scroll compressor can accordingly be utilized to increase the heating capacity of the refrigerant exiting the compression chambers by injecting the refrigerant into the compression chambers at a pressure and temperature greater than that of the refrigerant originating from the suction port of the vapor injection scroll compressor. The refrigerant exiting the vapor injection scroll compressor can accordingly be delivered to the cabin condenser at a greater temperature than would be possible if the vapor injection scroll compressor were operating in the absence of the injection of the heated vapor at the intermediate position within the compression chambers.

However, one disadvantage of the use of the vapor injection scroll compressor includes the need for the thermal management system to integrate additional components in order to recirculate the refrigerant back through the vapor injection scroll compressor at a suitable temperature and pressure for injecting the refrigerant back into the compression chambers in accordance with a selected mode of operation of the thermal management system. Such systems typically include a bypass pathway branching from a position downstream of the cabin condenser for the return of the refrigerant while bypassing the remainder of the corresponding primary refrigerant circuit. The bypass pathway also typically includes an expansion element to adjust a temperature and/or pressure of the refrigerant prior to injection into the compression chambers, and may optionally include an inner heat exchanger downstream of the expansion element to add heat to the recirculated refrigerant from the refrigerant flowing along the primary refrigerant circuit following the reduction in temperature within the expansion element. The introduction of these additional components adds cost and complexity to the resulting thermal management system.

Another concern with the above-described system relates to the manner in which the vapor injection scroll compressor is still receiving refrigerant that has already released heat to the ambient air within the cabin condenser due to the downstream arrangement of the branching of the fluid low path relative to the cabin condenser. Also, if an inner heat exchanger is used downstream of the expansion element, the reheating of the refrigerant similarly occurs with respect to a flow of the refrigerant having already released heat within the cabin condenser. The introduction of the vapor injection scroll compressor into the thermal management system may accordingly not account for and address the concerns raised by especially low ambient air temperatures for the same reasons evident in the traditional thermal management system lacking vapor injection as described above. The pressure of the refrigerant must also be lowered significantly within the expansion element disposed along the bypass pathway to prepare the refrigerant for reentry into the compressor, which results in a significant drop in temperature in the refrigerant. The expansion of the refrigerant along the bypass pathway accordingly results in a limited ability to add heat capacity to the cabin condenser via use of such a configuration.

Another approach to adding heat to the air to be delivered to the passenger cabin may include incorporating a heating device such as an electrically powered positive temperature coefficient (PTC) heater into a flow path for the air to be delivered to the passenger compartment. However, the introduction of such a heating device adds expense and complexity to the thermal management system, and further includes the need to adapt a corresponding heating, ventilating, and air conditioning (HVAC) housing to include the heating device at a suitable position for adequately heating the air.

It would therefore be desirable to provide a thermal management system having a vapor injection scroll compressor capable of improving the heating capacity of a downstream-arranged cabin condenser in response to increased heating demands.

SUMMARY OF THE INVENTION

Consistent and consonant with the present invention, a vapor injection scroll compressor having a discharge recirculation feature for increasing a heating capacity of a corresponding refrigerant circuit has surprisingly been discovered.

According to an embodiment of the present invention, a compressor comprises a compression space in which a refrigerant is compressed with the compression space including a discharge port and an injection port. A discharge chamber is fluidly coupled to the compression space by the discharge port. An injection chamber is fluidly coupled to the compression space by the injection port. A discharge recirculation pathway selectively provides fluid communication between the discharge chamber and the injection chamber.

A method of operating a compressor according to the invention is also disclosed. The method comprises the steps of: discharging a refrigerant from a compression space to a discharge chamber, the discharged refrigerant having a discharge pressure; fluidly communicating the refrigerant disposed within the discharge chamber to an injection chamber, the refrigerant having an injection pressure when in the injection chamber; and injecting the refrigerant at the injection pressure into the compression space to increase a pressure and temperature of the refrigerant within the compression space.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawing which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner.

Figure 1:
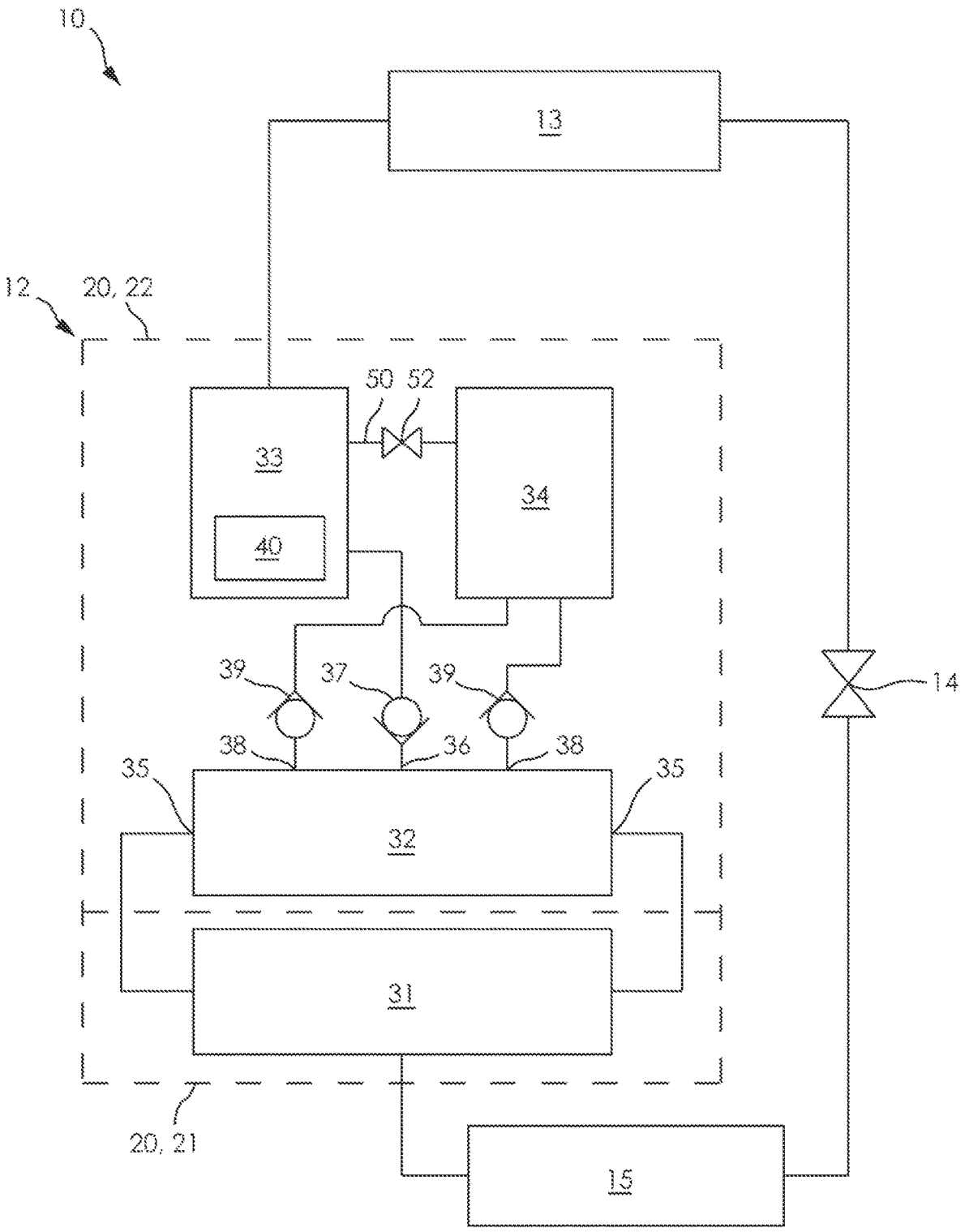
FIG. 1 shows a schematic flow diagram of a refrigerant circuit having a compressor with a discharge recirculation feature according to an embodiment of the invention.
Figure 2:
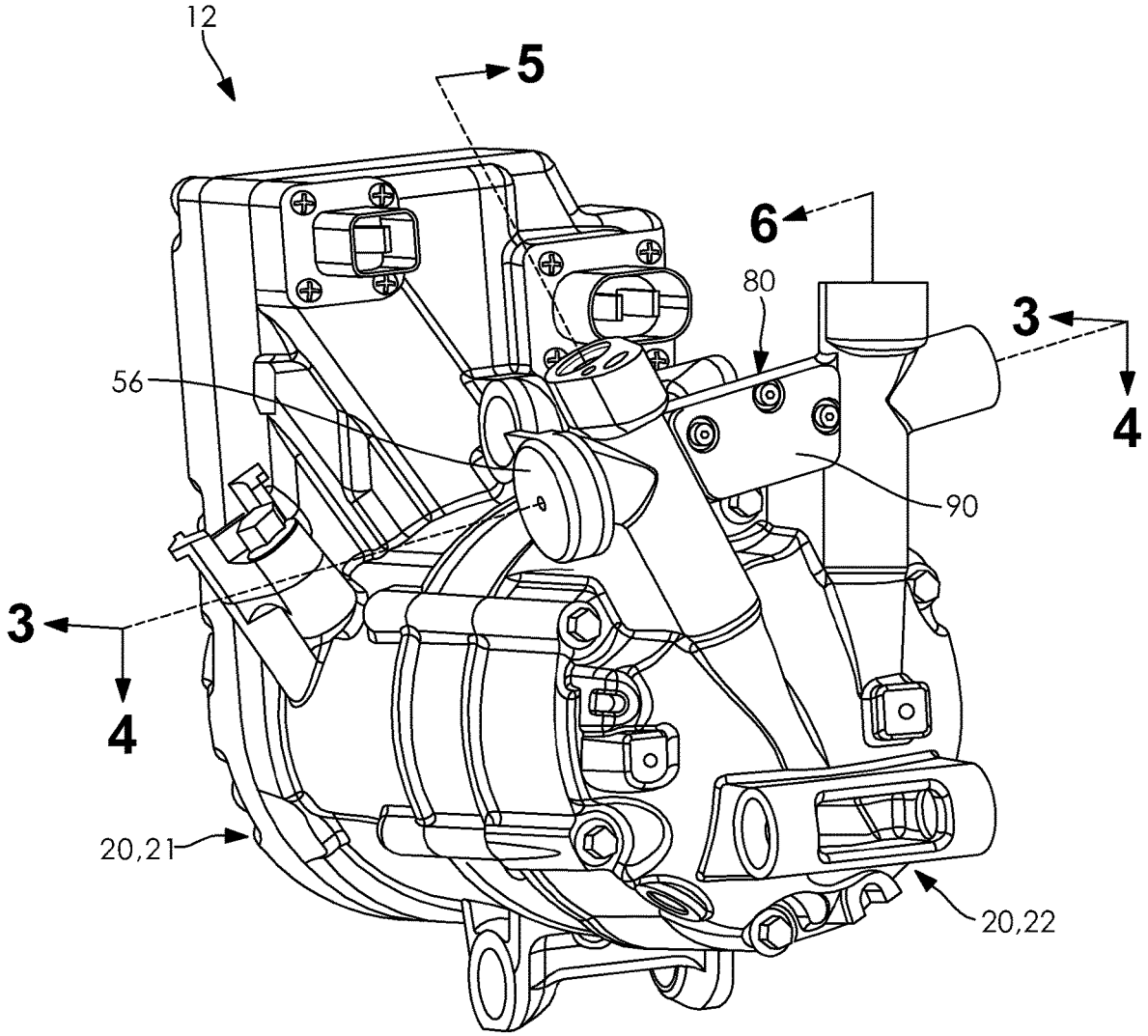
FIG. 2 is a perspective view of a compressor having the discharge recirculation feature according to an embodiment of the invention.

FIG. 1 illustrates a refrigerant circuit 10 according to an embodiment of the present invention. The refrigerant circuit 10 may form a portion of a thermal management system of a vehicle. The vehicle may be a hybrid or electric vehicle relying upon stored electrical power to provide heat to various components of the vehicle as well as the air to be delivered to the passenger cabin of the vehicle via the operation of the thermal management system and the corresponding refrigerant circuit 10.

The refrigerant circuit 10 includes at least a compressor 12, a first heat exchanger 13, an expansion element 14, and a second heat exchanger 15. The refrigerant circuit 10 as disclosed in FIG. 1 is simplified in nature and may include additional flow paths, valves, and/or components from those illustrated without necessarily departing from the scope of the present invention, so long as the same relationships are present within the refrigerant circuit 10 for prescribing operation thereof in the manner described hereinafter.

The refrigerant circuit 10 may be configured to operate in a heat pump mode of operation wherein the refrigerant is compressed and heated within the compressor 12 before flowing into the first heat exchanger 13. The first heat exchanger 13 may be configured as a cabin condenser when the refrigerant circuit 10 is operable in the heat pump mode, wherein the first heat exchanger 13 may be disposed within an HVAC air-handling casing (not shown) of the associated vehicle for selective heat exchange relationship with air to be delivered to the passenger cabin. The heated refrigerant releases heat to the air passing over the first heat exchanger 13, thereby heating the air and cooling and condensing the refrigerant. The cooled liquid refrigerant is then expanded within the expansion element 14 before being heated and evaporated within the second heat exchanger 15, which acts as an evaporator of the refrigerant circuit 10 with respect to the described flow configuration, before returning to an inlet side of the compressor 12 as a relatively low temperature and pressure gas.

Although not shown, the refrigerant circuit 10 may include various fluid lines and/or valves for prescribing an opposite flow configuration through the refrigerant circuit 10 from that described above with reference to the heat pump mode of operation. For example, the refrigerant circuit 10 may also be operable wherein the refrigerant generally flows in a counterclockwise direction (with reference to FIG. 1) after exiting the compressor 12 via the use of an appropriate valve and flow path arrangement adjacent the compressor 12, thereby causing the refrigerant to flow in order through the second heat exchanger 15, the expansion element 14, and then the first heat exchanger 13. Such an opposing flow configuration may result in the first heat exchanger 13 acting as a cabin evaporator, wherein heat is transferred from the air to be delivered to the passenger cabin to the refrigerant within the first heat exchanger 13. The first heat exchanger 13 may accordingly be operable as either a heating or a cooling device depending on the order of flow through the refrigerant circuit 10, as desired, if such a bidirectional flow configuration is utilized. An example of such a variable and/or bi-directional flow configuration is disclosed in U.S. Pat. Appl. Pub. No. 2013/0025311A1 to Graf et al., the entire contents of which are hereby incorporated herein by reference.

In other embodiments, the refrigerant circuit 10 may be devoid of such an opposing flow configuration, and may instead incorporate the second heat exchanger 15 into the corresponding HVAC air-handling casing to act as the cabin evaporator when the refrigerant circuit 10 is operable in the described heat pump mode. That is, the second heat exchanger 15 may be disposed within such an HVAC air-handling casing to be selectively passed by the refrigerant in order to cool the air to be delivered to the passenger cabin based on the selection of an air-conditioning mode of operation by a passenger of the vehicle.

The refrigerant circuit 10 may also be in heat exchange communication or fluid communication with additional components or systems of the associated vehicle in order to heat and/or cool such components or systems. For example, additional heat exchangers may be in fluid communication with the refrigerant of the refrigerant circuit 10, wherein these heat exchangers may be provided as chillers for cooling a battery of the vehicle, heat generating electronic components of the vehicle, or the like. Such chillers may be in fluid and/or heat exchange communication with one or more secondary coolants associated with such secondary systems. In other circumstances, such heat exchangers may be provided to heat such electronic components from a cold initial state in order for such electronic components to operate most efficiently, or to potentially evaporate or thaw water or ice accumulated on such components.

In any event, it is assumed hereinafter that the refrigerant circuit 10 is operable in the heat pump mode with the refrigerant flowing in a direction from the compressor 12 towards the first heat exchanger 13 such that the first heat exchanger 13 acts as a condenser for cooling the refrigerant passing therethrough and heating any fluid passed thereover, wherein such fluid may be air delivered to the passenger cabin of the associated vehicle. It should be readily appreciated by one skilled in the art that the structure described hereinafter may be incorporated into the corresponding refrigerant circuit 10 at substantially any position between the downstream arranged side of the compressor 12 and the upstream arranged side of the first heat exchanger 13 without necessarily departing from the scope of the present invention, although certain positions and configurations may be preferred for reducing the number of components necessary in achieving the beneficial features of the refrigerant circuit 10 and the compressor 12, as well as for returning the refrigerant at a desired pressure and temperature for appreciating the benefits of the disclosed thermal management system.

The compressor 12 is shown schematically in FIG. 1 as including a housing 20 that may be divided into a first housing 21 and a second housing 22. In the provided embodiment, the first housing 21 may be what is traditionally referred to as the "front housing" of the compressor 12 while the second housing 22 may be what is traditionally referred to as the "rear housing" thereof. The front housing 21 may be disposed towards a first end of the housing 20 into which the refrigerant first enters compressor 12, which corresponds to an inlet end of the compressor 12, while the rear housing 22 may be disposed towards a second end of the housing 20 at which the refrigerant exits the compressor 12 following compression therein, which corresponds to an outlet end of the compressor 12. The front housing 21 and the rear housing 22 may each be provided as a substantially hollow shell defining an open space therein, and the housings 21, 22 may be coupled to each other along a circumferentially extending seam with an open space formed by the cooperation of the housings 21, 22 housing the various components of the compressor 12.

The compressor 12 generally includes a suction chamber 31, a compression space 32, a discharge chamber 33, and a vapor injection chamber 34. The suction chamber 31 may be disposed within the front housing 21 and forms a space into which relatively low pressure and low temperature gaseous refrigerant is first introduced into the housing 20 for delivery to the compression space 32. The compression space 32 refers to a space within the housing 20 wherein an orbiting scroll (not shown) orbits relative to a fixed scroll (not shown) for repeatedly forming pairs of compression chambers (not shown) therebetween within the compression space 32. These compression chambers repeatedly form and progress radially inwardly from a radially outer portion of the compression space 32 towards a radial center of the compression space 32 during the orbiting of the orbiting scroll relative to the fixed scroll. This constant radial progression of the compression chambers results in the refrigerant contained within each of the compression chambers increasing in pressure towards the radial center of the compression space 32. Additionally, this progression also results in each position found within the compression space 32 being subjected to a variable and substantially cyclic pressure as the repeatedly formed compression chambers pass thereby while progressively increasing in pressure due to the decreasing volume of each of the compression chambers.

The compression space 32 may include at least one inlet 35 for introducing the refrigerant into the compression space 32 at the suction pressure as well as at least one discharge port 36 for expelling the refrigerant from the compression space 32 at a discharge pressure following the compression thereof within each of the radially inwardly progressing compression chambers. Each of the inlets 35 may be provided as an opening formed in an outer circumferential wall of the corresponding fixed scroll or orbiting scroll for providing fluid communication between the suction chamber 31 and the compression space 32, as one non-limiting example. The discharge port 36 may be provided as an opening in an axial end wall of the fixed scroll at or adjacent the radial center thereof for providing fluid communication between the compression space 32 and the discharge chamber 33, as one non-limiting example. The general configuration and method of operation of a scroll compressor having such a compression space formed by an orbiting scroll moving relative to a fixed scroll is disclosed in commonly owned U.S. Pat. No. 11,002,272 to Klotten et al., the entire contents of which are hereby incorporated herein by reference.

A discharge check valve 37 may be disposed at the discharge port 36 between the compression space 32 and the discharge chamber 33. The discharge check valve 37 is configured to open only when a pressure of the refrigerant within the compression space 32 at the position of the discharge port 36 exceeds the pressure of the refrigerant within the discharge chamber 33 as well as any bias introduced by the discharge check valve 37. The discharge check valve 37 may be a reed valve that flexes relative to the corresponding discharge port 36 each time the described pressure and force differential is reached during the repeated progression of the compression chambers towards the discharge port 36, wherein such flexing tends to open the passage through the discharge port 36. However, alternative one-way check valve configurations may be utilized without necessarily departing from the scope of the present invention. The discharge check valve 37 ensures that the refrigerant does not undesirably back-flow into the compression space 32 during the cycling of the orbiting scroll relative to the fixed scroll.

The compression space 32 may further include a pair of injection ports 38 for providing selective fluid communication between the compression space 32 and the vapour injection chamber 34. Each of the injection ports 38 may be provided as an opening formed in the axial end wall of the fixed scroll intermediate the inlets 35 and the discharge port 36 with respect to the radial direction of the fixed scroll, as one non-limiting example. The manner in which the injection ports 38 communicate with the compression space 32 at a position radially intermediate the inlets 35 and the discharge port 36 is shown schematically in FIG. 1.

An injection check valve 39 may be disposed at each of the injection ports 38 between the compression space 32 and the vapour injection chamber 34. Each of the injection check valves 39 is configured to open only when a pressure of the refrigerant within the vapour injection chamber 34 exceeds the pressure of the refrigerant within the compression space 32 at the position of the corresponding injection port 38 as well as any bias introduced by the associated injection check valve 39. Each of the injection check valves 39 may be a reed valve that flexes relative to the corresponding injection port 38 each time the described pressure and force differential is reached during the repeated progression of the compression chambers towards the discharge port 36, wherein such flexing tends to open the passage through the corresponding injection port 38 for providing the selective fluid communication between the vapour injection chamber 34 and the instantaneously aligned one of the compression chambers formed within the compression space 32.

Each of the injection check valves 39 ensures that the refrigerant does not undesirably flow from the compression space 32 to the vapour injection chamber 34 during the cycling of the orbiting scroll relative to the fixed scroll. The injection check valves 39 further ensure that the refrigerant allowed to enter the compression space 32 from the vapour injection chamber 34 via one of the injection ports 38 is always at a greater pressure than the refrigerant already within the compression space 32 within one of the radially inwardly progressing compression chambers, thereby ensuring an increase of pressure (and hence temperature) within the corresponding compression chamber via the described vapour injection process. The refrigerant entering the compression chambers from the vapour injection chamber 34 is accordingly at an intermediate injection pressure that is intermediate the instantaneous suction pressure and instantaneous discharge pressure of the compressor 12. The injection check valves 39 may be representative of the vapour injection double reed valve assembly operating within a vapour injection scroll compressor as disclosed in U.S. Pat. Appl. Pub. No. 2021/0285445 A1 to Bhatia et al., the entire contents of which are hereby incorporated herein by reference. However, alternative one-way check valve structures may be utilized while remaining within the scope of the present invention, as desired.

The discharge chamber 33 may include an oil separator 40 disposed therein for removing oil from the discharge refrigerant. The oil separator 40 may be any structure configured for the removal of such oil, and may include a centrifugal feature or surface area increasing feature for capturing the oil exposed to the oil separator 40. Any suitable oil separator 40 may be utilized while remaining within the scope of the present invention.

As shown schematically in FIG. 1, the discharge chamber 33, the vapour injection chamber 34, and at least a portion of the compression space 32, if not an entirety thereof, may be formed or otherwise disposed within the rear housing 22 of the housing 20. The various different spaces may be defined at least partially by some combination of the internal surfaces of the rear housing 22, the surfaces of the fixed scroll, the surfaces of the orbiting scroll, and the surfaces forming any intervening valve assemblies, such as the described check valves 37, 39. The front housing 21 may include the suction chamber 31 as well as the components necessary for causing the orbiting of the orbiting scroll relative to the fixed scroll.

The compressor 12 is distinguished from the vapour injection scroll compressors of the prior art via the introduction of a discharge recirculation pathway 50 formed within the housing 20 for fluidly coupling the discharge chamber 33 to the vapour injection chamber 34. The refrigerant disposed within the discharge chamber 33 is selectively communicated to the vapour injection chamber 34 through the discharge recirculation pathway 50 via the operation of a flow control valve 52 disposed therealong. The flow control valve 52 may be configured to provide a variable orifice through which the refrigerant is able to flow when flowing from the discharge chamber 33 to the vapour injection chamber 34, wherein the flow area through the variable orifice determines a flow rate of the recirculated refrigerant flowing into the vapour injection chamber 34 from the discharge chamber 33, as well as altering a change in temperature and pressure of the refrigerant passing through the flow control valve 52 depending on the degree of contraction and expansion of the flow area through the flow control valve 52 relative to the upstream and downstream arranged segments of the discharge recirculation pathway 50.

The described discharge recirculation pathway 50 and flow control valve 52 accordingly allow the compressor 12 to be operable in a discharge recirculation mode of operation wherein the refrigerant having the discharge pressure within the discharge chamber 33 is able to be fluidly communicated to the vapour injection chamber 34 for injection into the compression space 32 at the intermediate injection pressure via one of the injection check valves 39. The intermediate injection pressure may differ from the discharge pressure by the pressure loss experienced by the refrigerant when passing through the discharge recirculation pathway 50 and the flow control valve 52. The intermediate injection pressure is therefore maximized when the variable orifice through the flow control valve 52 is adjusted to a maximized flow area therethrough, which corresponds to a minimized pressure loss of the refrigerant through the flow control valve 52. The refrigerant at the intermediate injection pressure is injected into the compression space 32 and a corresponding compression chamber via one of the injection ports 38 when at a pressure greater than that instantaneously disposed within the corresponding compression chamber, which in some circumstances may substantially correspond to the instantaneous suction pressure of the refrigerant during the initial formation of the corresponding compression chamber.

The injection of the refrigerant at the increased pressure into the compression chamber results in the total pressure of the refrigerant within the compression chamber increasing, which directly corresponds to the temperature of the refrigerant contained within the corresponding compression chamber increasing. This increased temperature of the refrigerant within the compression space 32 results in the refrigerant discharged to the discharge chamber 33 having a greater temperature than would be the case if no recirculation of the refrigerant had occurred via the described injection process. This increased temperature discharge refrigerant is then able to be partially recirculated once again via the discharge recirculation pathway 50. Repetition of this process at a given operational state of the compressor 12 accordingly results in a progressive increase in the temperature of the discharge refrigerant for each cycle until a new recirculation discharge temperature is reached, which is greater than the discharge temperature of the refrigerant associated with operation of the compressor 12 at the same settings and devoid of the recirculation feature. The discharge recirculation process accordingly results in the discharge refrigerant exiting the compressor 12 and reaching the first heat exchanger 13 having a greater temperature than would be the case absent the recirculation process, which in turn increases the heating capacity of the first heat exchanger 13 during the discharge recirculation mode of operation of the compressor 12.

It has been discovered through experimentation with respect to various compressors having the general configuration of that disclosed in FIG. 1 that the use of the disclosed discharge recirculation feature results in the ability to significantly increase the discharge temperature of the refrigerant while maintaining a coefficient of performance (COP) of greater than 1.0 of the corresponding compressor. It has been discovered, for example, that it is possible to increase the discharge temperature of the refrigerant of such a compressor by as much as 30-70° C., depending on the compressor configuration, while maintaining the COP of greater than 1.0. It has also been found that this temperature increase occurs in conjunction with a decrease in the mass flow rate of the refrigerant exiting the compressor of less than 10% in comparison to the mass flow rate associated with operation of the corresponding compressor in the absence of the discharge recirculation feature.

The ability to operate the compressor with a COP of greater than 1.0 while desirably increasing the temperature of the discharge refrigerant in accordance with passenger heating demands indicates that the disclosed discharge recirculation feature may be utilized in place of the addition of a heating device such as an electrically powered PTC heater, which may be incorporated into the HVAC casing of the associated vehicle for further heating the air delivered to the passenger cabin. The incorporation of the discharge recirculation feature into the compressor 12 accordingly allows the corresponding HVAC casing to be provided with a minimal number of components, thereby simplifying the thermal management system having the refrigerant circuit 10 and the compressor 12.

The flow control valve 52 may be configured to be adjustable to a fully closed position for preventing flow through the discharge recirculation pathway 50 from the discharge chamber 33 to the vapour injection chamber 34. The flow control valve 52 may be further configured to be adjustable away from the fully closed position to a fully open position for maximizing the flow area through the discharge recirculation pathway 50. The flow control valve 52 may also be configured to be adjustable to a plurality of intermediate positions corresponding to different flow areas through the discharge recirculation pathway 50 between the fully closed and the fully open position, wherein each different flow area corresponds to a different flow rate of the refrigerant through the flow control valve 52, as well as a different change in pressure and temperature of the recirculated refrigerant. However, in some alterative embodiments, the flow control valve 52 may not include an adjustable flow feature, and may instead be configured to only be adjustable between an open position for allowing the discharge recirculation process and a closed position for preventing the discharge recirculation process, as desired.

The adjustment of the flow control valve 52 may be determined by various factors associated with operation of the compressor 12 and/or the remainder of the refrigerant circuit 10. In some circumstances, the flow control valve 52 may be controlled to a desired configuration corresponding to a prescribed flow of the refrigerant through the recirculation pathway 50, wherein such control may be based on a selected mode of operation or sensed conditions within the compressor 12 or along the remainder of the refrigerant circuit 10. For example, temperature sensors may be disposed along the refrigerant circuit 10 at desired positions for monitoring the temperature of the refrigerant at relevant positions related to the heating capacity of the refrigerant, such as within the discharge chamber 33, immediately upstream of the first heat exchanger 13, immediately downstream of the first heat exchanger 13, or combinations thereof, among other possible positions.

The flow control valve 52 may only be opened when the described recirculation feature is necessary for meeting the heating demands of the refrigerant circuit 10, such as when a temperature of the refrigerant at one or more of the described positions is sensed as being below that necessary for heating the air delivered to the passenger cabin to an acceptable extent, as may occur when the first heat exchanger 13 is exposed to especially low ambient air temperatures. The flow control valve 52 may alternatively be controlled based on a sensed temperature of the air being delivered to the passenger cabin, wherein the recirculation feature may be engaged when the temperature of the air delivered to the passenger compartment is not heated in accordance with the passenger selected setting. The flow control valve 52 may also be controlled based on any combination of such factors, as desired.

The flow control valve 52 may be adjusted to the fully open position when a maximum flow of the refrigerant is desired from the discharge chamber 33 to the vapour injection chamber 34, which also corresponds to a minimized reduction in temperature and pressure of the recirculated refrigerant when passing through the flow control valve 52. This maximized pressure and temperature of the refrigerant within the vapour injection chamber 34 corresponds to a maximized increase in pressure and temperature of the refrigerant instantaneously disposed within the compression space 32 when the vapour is injected therein, which in turn corresponds to a maximized increase in the pressure and temperature of the discharge refrigerant exiting the compression space 32 through the discharge port 36.

The fully open position of the flow control valve 52 may accordingly correspond to situations wherein an especially high heating demand is placed on the refrigerant circuit 10, such as when the refrigerant is exchanging heat with ambient air at especially low temperatures within the cabin condenser 13. The flow control valve 52 may be adjusted to any of the intermediate positions in order to meet a desired or prescribed heating demand of the refrigerant circuit 10 intermediate that corresponding to the fully closed position and the fully open position.

The flow control valve 52 may be configured to be closed or initially moved towards the closed position when a temperature of the refrigerant exceeds a preselected value associated with potential damage or inefficient operation of the compressor 12 and/or any other components disposed along the refrigerant circuit 10. The flow control valve 52 may be configured to cease the recirculation feature of the compressor 12 when the temperature of the refrigerant at any selected position along the refrigerant circuit 10, including within the compressor 12, exceeds one of the acceptable preselected temperature values associated with the various components along the refrigerant circuit 10.

The flow control valve 52 may also be adjusted to the fully closed position when the recirculation of the discharge refrigerant back to the vapour injection chamber 34 is not required, such as when the heating demand placed on the refrigerant circuit 10 is low during operation in the described heat pump mode, or when the refrigerant circuit 10 is being operated in an alternative mode of operation not requiring especially high temperatures of the refrigerant downstream of the compressor 12, such as when the refrigerant circuit 10 is operated in order to cool the air delivered to the passenger cabin or other heat generating components of the vehicle.

Referring now to FIGS. 2-8, an implementation of the compressor 12 of FIG. 1 is shown according to a first embodiment of the present invention. The compressor 12 includes a temperature dependent form of the flow control valve 52 for passively limiting the temperature of the refrigerant discharged from the compressor 12. FIGS. 3-8 illustrate only the rear housing 22 of the compressor 20 in the absence of the front housing 21 (as well as various components related to operation of the compressor 12) to better show the features of the discharge recirculation pathway 50 and the flow control valve 52, which are disposed exclusively within the rear housing 22 of the present embodiment. It should be understood that any components omitted from FIGS. 3-8 operate relative to the illustrated components in the same manner as described with reference to FIG. 1, hence further illustration and description is not required.

The rear housing 22 is shown as including a discharge chamber 33 that is divided into a first portion 33*a* and a second portion 33*b*. The first portion 33*a* is disposed immediately downstream of the corresponding discharge port 36 (not shown in FIGS. 3-8) and the second portion 33*b* is arranged downstream of and extending away from the first portion 33*a*. A flow opening 33*c* fluidly connects the first portion 33*a* to the second portion 33*b*. The second portion 33*b* is shown as a cylindrically shaped conduit extending in a direction at least partially radially outwardly relative to the position of a corresponding discharge port 36 of the compressor 12. The second portion 33*b* may be formed as a bore externally introduced into the rear housing 22, as desired. An end of the second portion 33*b* opposite the first portion 33*a* is configured for coupling to an external fluid line, component, or the like, for communicating the refrigerant downstream of the compressor 12. For example, the second portion 33*b* may be fluidly coupled to a fluid line leading towards the first heat exchanger 13.

Although not pictured in FIGS. 3-8, the described oil separator 40 may be introduced into the discharge chamber 33 at or immediately downstream of the position of the illustrated flow opening 33*c* and at a position upstream of the discharge recirculation pathway 50 to ensure that oil is removed from the discharge refrigerant prior to introduction into the discharge recirculation pathway 50. The oil separator 40 may be an oil ring incorporated into the cylindrical structure of the second portion 33*b* of the discharge chamber 33. However, the oil separator 40 may be positioned anywhere within the discharge chamber 33 without necessary departing from the scope of the present invention, including at a position downstream of the discharge recirculation pathway 50, and may include any structure or configuration suitable for separating the oil from the refrigerant.

Figure 3:
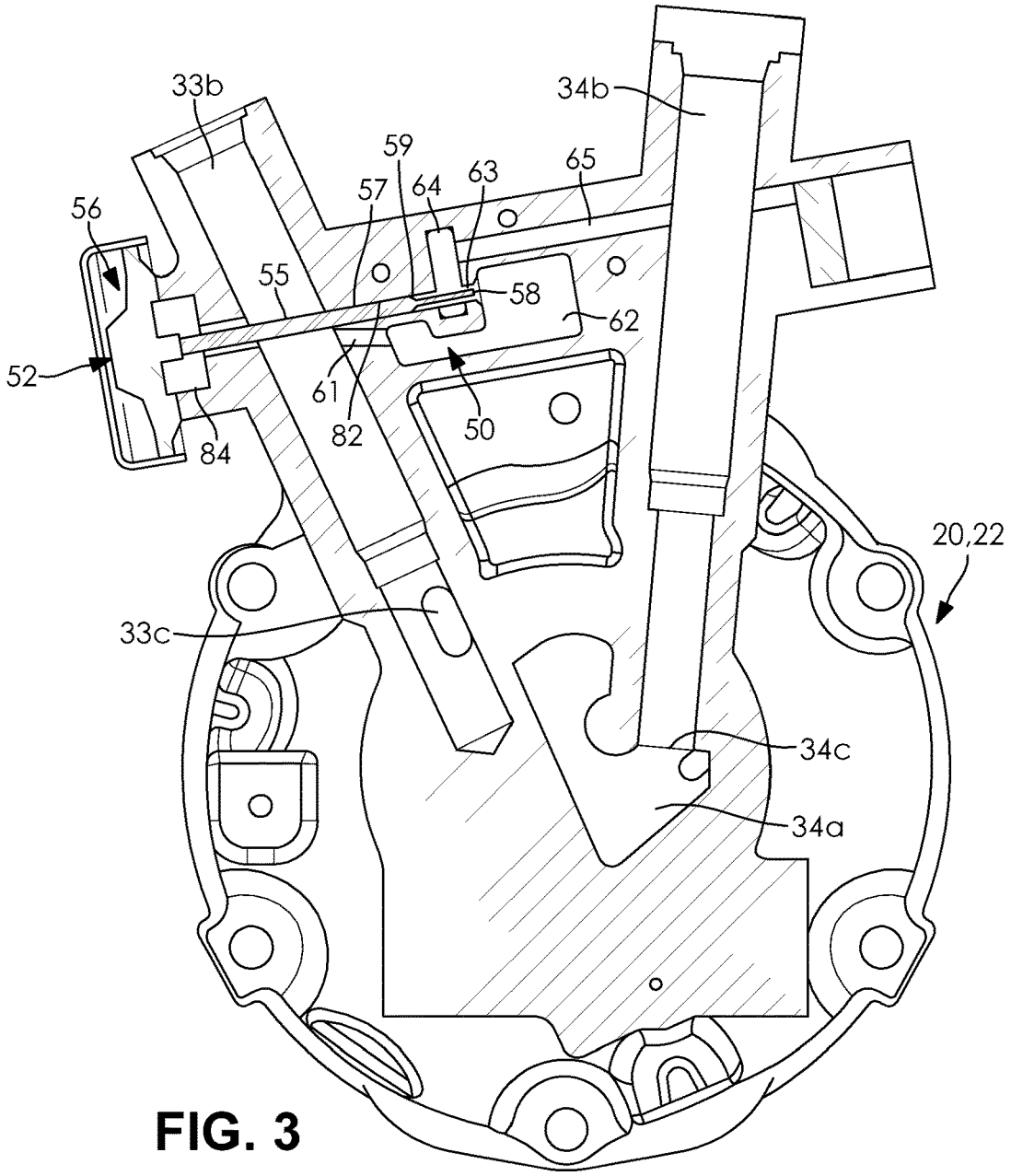
FIG. 3 is a cross-sectional view through a rear housing of the compressor as taken from the perspective of section lines 3-3 in FIG. 2.

The rear housing 22 is also shown as including a vapour injection chamber 34 that is divided into a first portion 34*a* and a second portion 34*b*. The first portion 34*a* is disposed immediately adjacent and upstream of the injection check valves 39 while the second portion 34*b* is arranged upstream of and extending away from the first portion 34*a*, wherein the described flow directions refer to a flow of the refrigerant into the vapour injection chamber 34 from the discharge chamber 33 via the corresponding discharge recirculation pathway 50. A flow opening 34*c* fluidly connects the first portion 34*a* to the second portion 34*b*. The second portion 34*b* is shown as a cylindrically shaped conduit extending in a direction at least partially radially outwardly relative to the position of a corresponding discharge port 36 of the compressor 12. The second portion 34*b* may be formed as a bore introduced externally into the rear housing 22, as desired. An end of the second portion 34*b* opposite the first portion 33*a* is shown as having the structure for coupling to an external fluid line, component, or the like, for communicating refrigerant to the compressor 12 for introduction into the vapour injection chamber 34. However, as shown in FIG. 3, this end of the second portion 34*b* may be capped to fluidly isolate the second portion 34*b* from external fluid communication via the end thereof, which corresponds to the flow configuration of the vapour injection chamber 34 relative to the discharge recirculation pathway 50 shown in FIG. 1. As explained hereinafter, the second portion 34*b* may alternatively be devoid of such capping to allow for the introduction of another flow of refrigerant into the compressor 12 for use in a vapour injection process via the connection of the second portion 34*b* to an external component.

The second portion 33*b* of the discharge chamber 33 and the second portion 34*b* of the vapour injection chamber 34 may be formed into the rear housing 22 to be angularly displaced from each other by an angle less than 90 degrees to ensure a direct and shortened extension of the discharge recirculation pathway 50 therebetween. The discharge recirculation pathway 50 may be formed within a bridge portion 80 of the rear housing 22 extending laterally between the radially extending portions of the rear housing 22 defining the cylindrically shaped portions 33*a*, 34*a* of the respective chambers 33, 34.

A guide opening 82 extends internally into the rear housing 22 from an outer surface thereof with the guide opening 82 intersecting and passing through the second portion 33*b* of the discharge chamber 33 before extending into and terminating within the connecting bridge portion 80. The guide opening 82 may be an externally introduced cylindrical bore formed into the rear housing 22. The discharge recirculation pathway 50 includes, in a direction of flow of the refrigerant flowing from the discharge chamber 33 towards the vapour injection chamber 34, a first flow segment 61, a first flow space 62, a tapered orifice 63, a second flow space 64, and a second flow segment 65. The first flow segment 61 forms an inlet into the pathway 50 and extends transversely from the second portion 33*b* of the discharge chamber 33 before intersecting the first flow space 62. The first flow space 62 include an L-shape to cause a downstream portion of the first flow space 62 to be extend around and be axially aligned with the guide opening 82. The irregular shape of the first flow space 62 allows a refrigerant velocity to be reduced before passing through the orifice 63, thereby reducing a pressure loss experienced during passage through the orifice 63. The orifice 63 is provided as an end segment of the guide opening 82 extending axially between the first flow space 62 and the second flow space 64. The second flow space 64 extends transversely away from the guide opening 82 before intersecting the second flow segment 65. The second flow segment 65 extends longitudinally towards and intersects the second portion 34*b* of the vapour injection chamber 34 to form an outlet of the pathway 50. The second flow segment 65 may be formed as an externally introduced cylindrical bore in similar fashion to the guide opening 82, wherein a portion of the rear housing 22 having the bore introduced therein may subsequently be capped.

Figure 4:
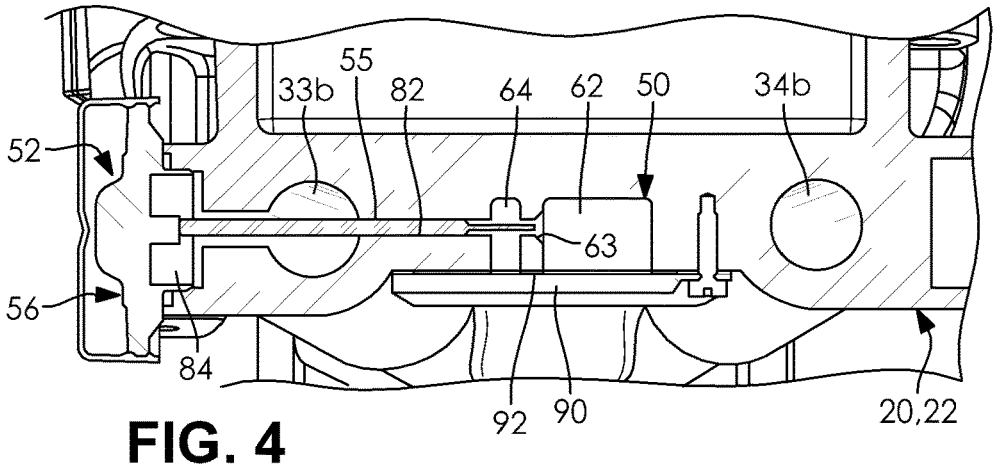
FIG. 4 is a fragmentary cross-sectional view through the rear housing of the compressor as taken from the perspective of section lines 4-4 in FIG. 2.
Figure 5:
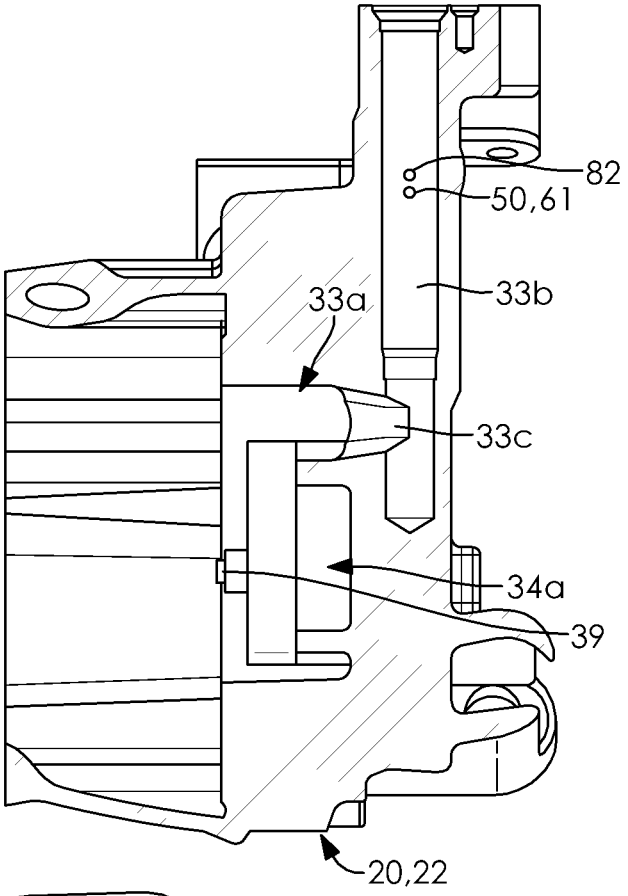
FIG. 5 is a cross-sectional view through the rear housing of the compressor as taken from the perspective of section line 5 in FIG. 2.
Figure 6:
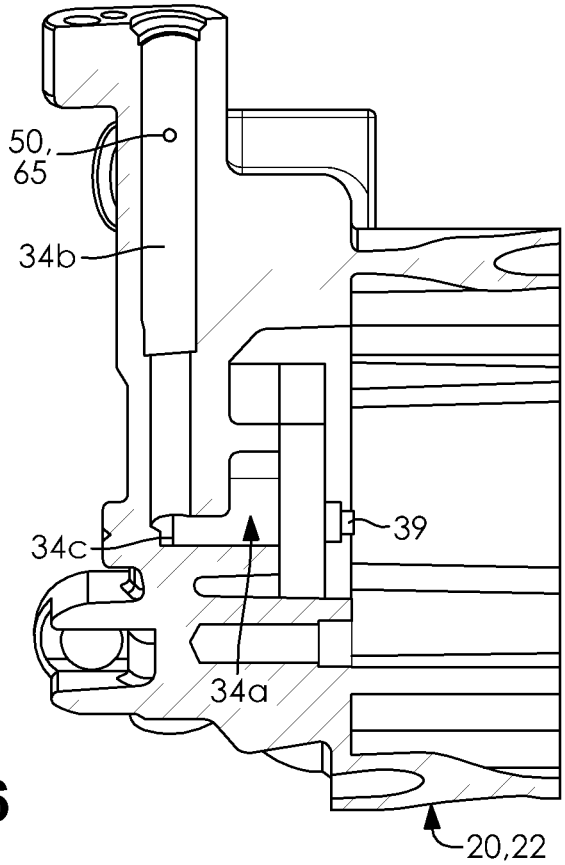
FIG. 6 is a cross-sectional view through the rear housing of the compressor as taken from the perspective of section line 6 in FIG. 2.
Figure 7:
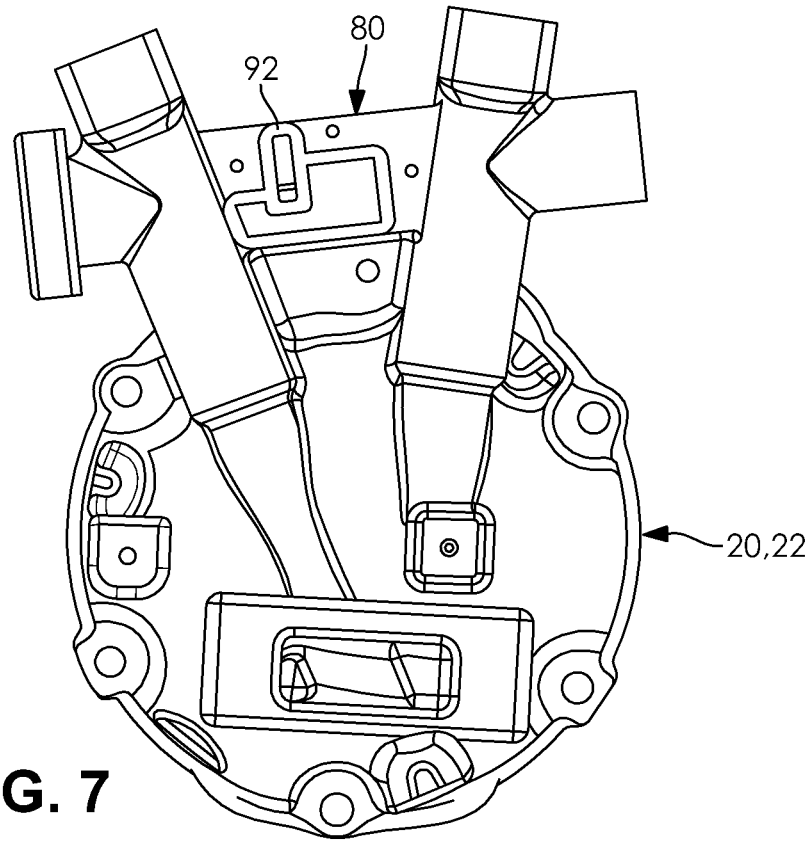
FIG. 7 is a front elevational view of the rear housing of compressor of FIG. 2 having a cover plate removed therefrom for exposing a sealing element.
Figure 8:
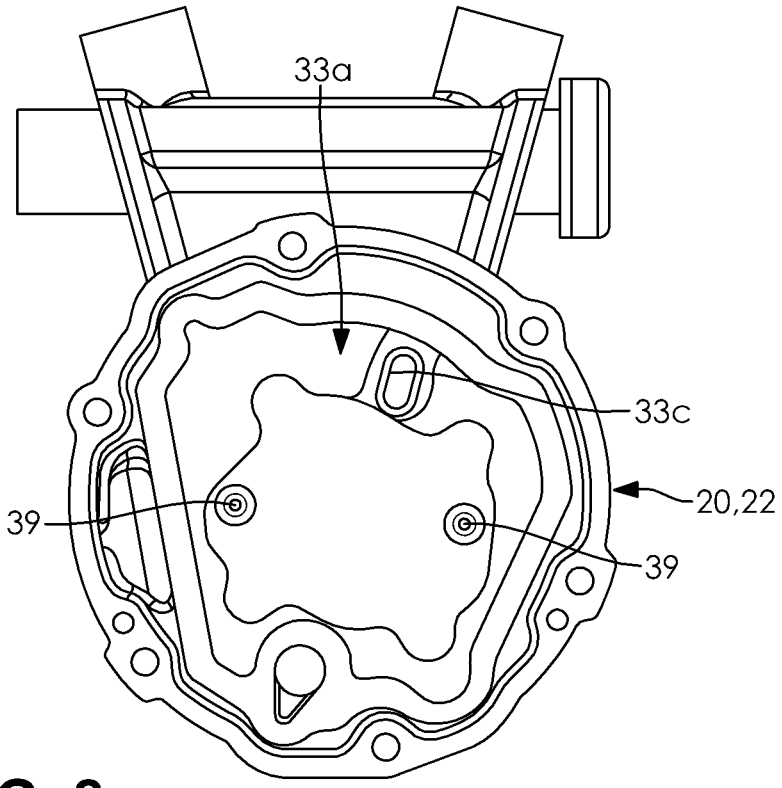
FIG. 8 is a rear elevational view of the rear housing of the compressor of FIG. 2.

The discharge recirculation pathway 50 as shown is defined between an indented outer surface of the bridge portion 80 of the rear housing 22 and a facing surface of a cover plate 90 coupled to the bridge portion 80 over the pathway 50. The cover plate 90 may be coupled to the rear housing 22 via threaded fasteners, as one non-limiting example. As shown in FIGS. 4 and 5, a sealing element 92 may be disposed between the outer surface of the bridge portion 80 and the facing surface of the cover plate 90 with the sealing element 92 shaped to extend around a periphery of the flow spaces 61, 62, 63, 64, 65 formed by the indented outer surface of the bridge portion 80. The sealing element 92 provides a fluid seal between the bridge portion 80 and the cover plate 90 with respect to the discharge recirculation pathway 50.

The use of various externally introduced bores and indentations introduced into the rear housing 22 in forming the discharge recirculation pathway 50 and associated features allows for an ease of manufacturing of the compressor 12. Such features are also easily accessible for repair or replacement in the event of damage or failure thereof.

The flow control valve 52 includes a flow control element 55 and a temperature dependent element 56. In the provided embodiment, the flow control element 55 is a cylindrical rod axially and slidably received within the guide opening 82. The flow control element 55 extends through the second portion 33*b* of the discharge chamber 33 and into the bridge portion 80 of the rear housing 22. The flow control element 55 may include a large diameter (cylindrical) portion 57 slidably engaging and dimensioned to fit the guide opening 82, a small diameter portion 58 formed at a distal end of the flow control element 55 extending into the flow spaces 62, 63, and a frustoconical portion 59 having a taper to connect the large diameter portion 57 to the small diameter portion 58.

The temperature dependent element 56 is disposed along the outer surface of the rear housing 22 and defines a communication space 84. The communication space 84 is in fluid communication with the second portion 33*b* of the discharge chamber 33 via a portion of the guide opening 82 surrounding the flow control element 55. The temperature dependent element 56 may include a thermally activated spring (not shown) that engages a diaphragm (not shown) connected to a proximate end of the flow control element 55. The thermally activated spring is configured to apply an increasing axial force to the diaphragm and the connected flow control element 55 when exposed to an increasing temperature. The thermally activated spring is able to react to the temperature of the discharge refrigerant within the second portion 33*b* of the discharge chamber 33 via the exposure of the temperature dependent element 56 to the refrigerant within the communication space 84. The increasing temperature of the discharge refrigerant accordingly corresponds to the flow control element 55 advancing into the bridge portion 80 of the rear housing 22 with the large diameter portion 57 approaching the orifice 63.

A flow area through the flow control valve 52 is determined by an axial position of the flow control element 55 relative to the orifice 63. As can be seen from review of FIGS. 3 and 4, continued axial advancement of the flow control element 55 initially includes the small diameter portion 58 thereof entering the orifice 63 and reducing the flow area thereof prior to the frustonical portion 59 subsequently entering the orifice 63 and progressively reducing the flow area thereof further. The orifice 63, and hence the discharge recirculation pathway 50, is closed when the large diameter portion 57 is received within the orifice 63, or alternatively when an end portion of the frustoconical portion 59 is seated against the surface defining the orifice 63.

The described flow control valve 52 having the temperature dependence is accordingly able to allow for maximized flow through the discharge recirculation pathway 50 for temperatures below a first threshold value, and then may begin to variably reduce the flow area and hence flow rate through the discharge recirculation pathway 50 with respect to a range of temperatures between the first threshold value and a second threshold value greater than the first threshold value. The flow control valve 52 may then completely close off the discharge recirculation pathway 50 when the second threshold temperature is reached, which may correspond to a maximum allowable safe temperature associated with operation of the compressor 12 and/or any components associated with the refrigerant circuit 10.

The illustrated flow control valve 52 may also be adapted to include a shut-off feature associated with a control system of the refrigerant circuit 10, wherein such a shut-off feature may be electronically controlled accordingly to a control scheme of the control system, which may include sensing any conditions of the compressor 12 and/or the refrigerant circuit 10 described hereinabove. For example, the flow control element 55 may also be mechanically linked to a solenoid-based actuator or the like configured to advance the flow control element 55 towards the closed position when an associated controller generates a control signal indicating that the recirculation feature is not required. Alternatively, a secondary valve element (not shown) may be utilized to open or close off the discharge recirculation pathway 50 at a position spaced from the illustrated orifice 63 and flow control element 55, such as providing an adjustable element configured to selectively extend across the second flow segment 65 in response to a generated control signal. Again, a solenoid or similar electrically adjustable and electronically controllable feature may be utilized to control the position of such a secondary valve element.

Figure 9:
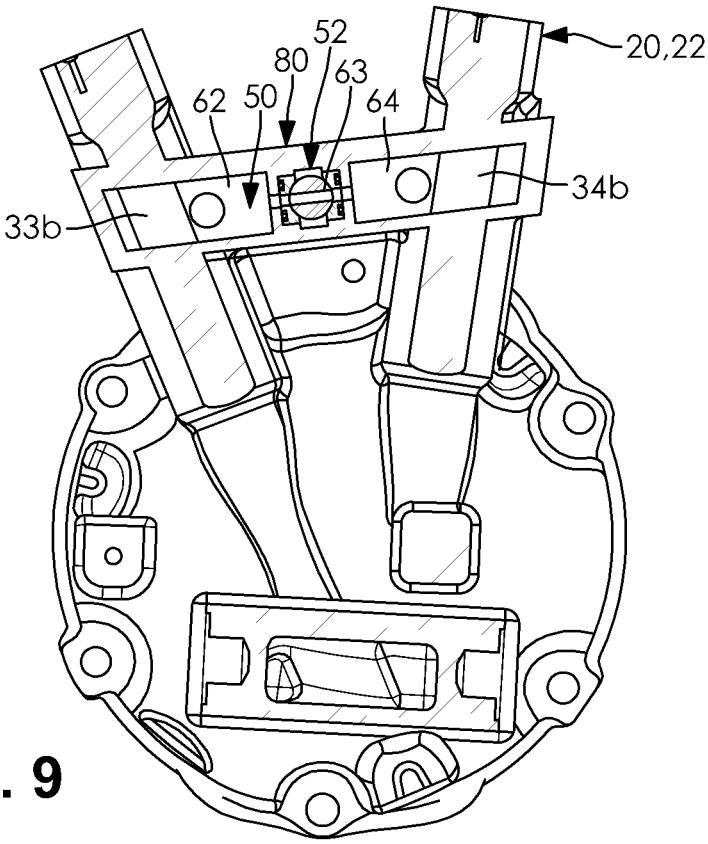
FIGS. 9 and 10 are cross-sectional views taken through a discharge recirculation pathway of a compressor according to another embodiment of the present invention.
Figure 10:
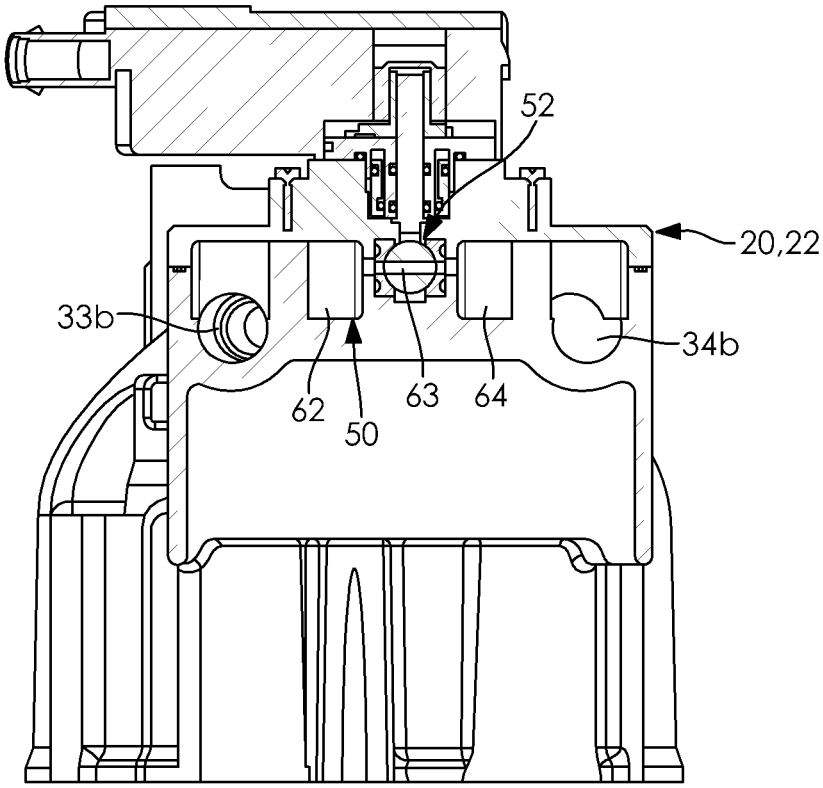

Referring now to FIGS. 9 and 10, another implementation of the discharge recirculation pathway 50 and associated flow control valve 52 is disclosed according to another embodiment of the present invention, wherein it is assumed that the remainder of the compressor 12 is otherwise identical and operates in the same fashion as that disclosed in FIG. 1 or that disclosed in FIGS. 2-8. The discharge recirculation pathway 50 includes a first flow space 62 acting as an inlet into the pathway 50 from the second portion 33*b* of the discharge chamber 33 and a second flow space 65 acting as an outlet from the pathway 50 to the second portion 34*b* of the vapour injection chamber 34. The flow control valve 52 is provided as a ball valve forming a variable orifice 63 intermediate the adjoining flow spaces 62, 64. The ball valve includes a rotatable ball element coupled to a rotor of an actuator. The actuator may be an electrically adjustable and electronically controllable rotary actuator configured to rotate the ball element relative to the flow spaces 62, 64. The ball element include a flow passage that includes a variable overlap with each of the flow spaces 62, 64 depending on the rotational position of the ball element, which corresponds to the formation of the variable orifice 63. The actuator may be configured to adjust the ball element to a fully closed position wherein no overlap and hence no flow area is present between the flow spaces 62, 64 and the flow passage through the ball element, a fully open position wherein a maximum overlap and flow area is present between the flow passage and the flow spaces 62, 64 due to an alignment of the flow passage with the flow spaces, and a plurality of intermediate positions including intermediate flow areas based on the variable overlap between the flow areas present between the flow passage and the flow spaces 62, 64.

The flow control valve 52 of FIGS. 9 and 10 may be operated according to any of the control schemes described hereinabove. For example, the flow control valve 52 may only be opened for flow through the discharge recirculation pathway 50 when the recirculation feature is required to attain a desired heating capacity of the first heat exchanger 13, and may further be closed during the recirculation process when the temperature of the discharge refrigerant exceeds a threshold value associated with potential damage to the compressor 12 and/or other components of the refrigerant circuit 10. The purely electronically controlled version of the flow control valve 52 does not include a passive shut-off feature, hence the determinations regarding the adjustment of the flow control valve 52 may be based upon the sensed conditions described hereinabove with regards to the refrigerant circuit 10 and/or the air delivered to the passenger cabin of the vehicle.

It should be understood that other configurations of the discharge recirculation pathway 50 may be provided within the rear housing 22 for use with other adjustable flow control valves 52 while remaining within the scope of the present invention, so long as the same basic relationships described herein are maintained. The disclosed mechanisms utilized in forming a variable orifice through the discharge recirculation pathway are accordingly non-limiting to the general configuration of the compressor 12 as disclosed in FIG. 1. The flow control valve 52 may be representative of alternative expansion valve configurations while remaining within the scope of the present invention.

Figure 11:
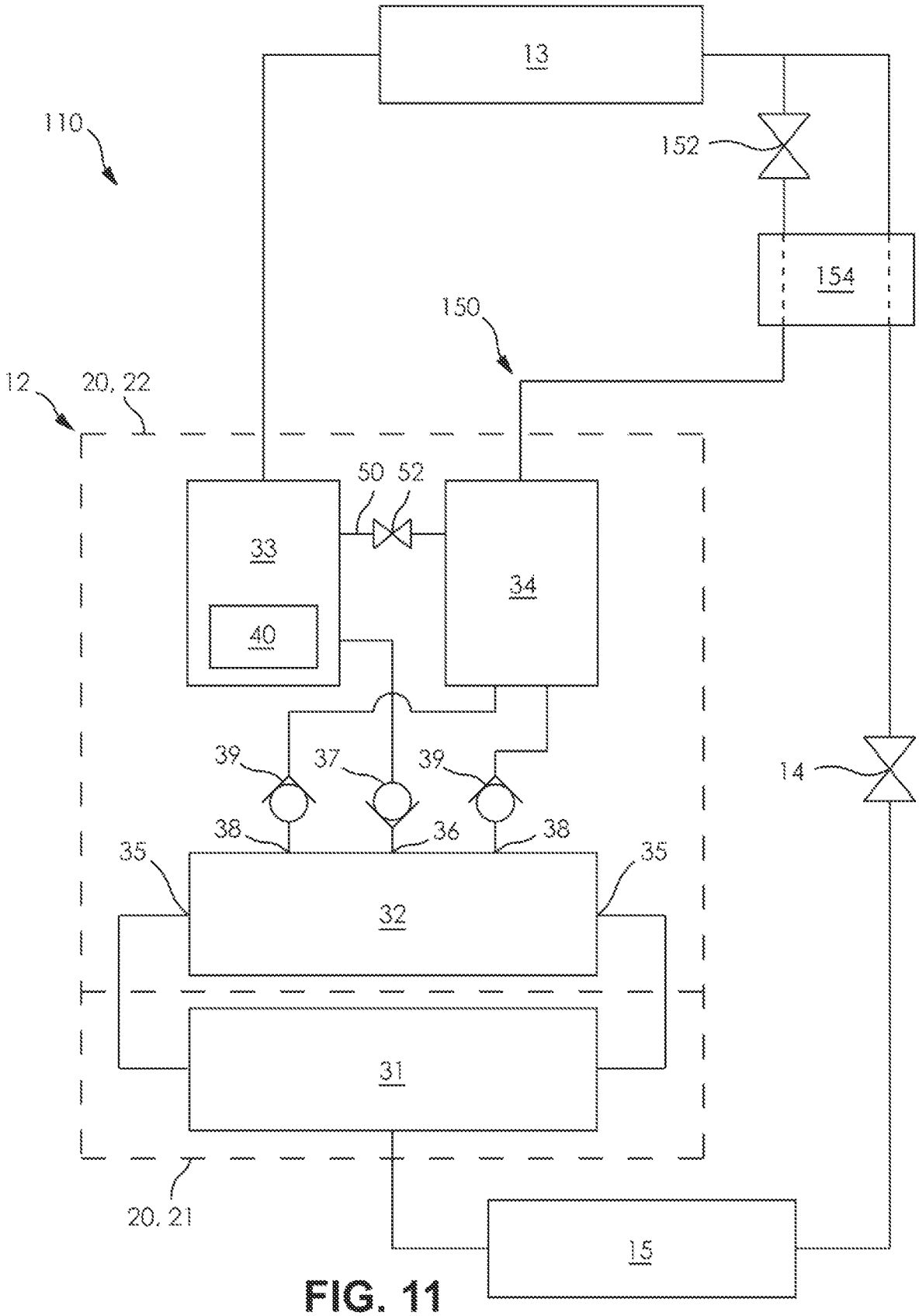
FIG. 11 shows a schematic flow diagram of a refrigerant circuit having a compressor with a discharge recirculation feature operating in conjunction with a recirculation bypass feature according to another embodiment of the invention.

Referring now to FIG. 11, a refrigerant circuit 110 according to another embodiment of the present invention is disclosed. The refrigerant circuit 110 is similar to the refrigerant circuit 10 and includes the compressor 12, first heat exchanger 13, expansion element 14, and second heat exchanger 15, which are referred to hereinafter as forming a primary loop of the refrigerant circuit 110. However, the refrigerant circuit 110 further includes a bypass feature similar to that typically found in refrigerant circuits operating with a vapour injection scroll compressor of the prior art (absent the presently disclosed discharge recirculation feature) in conjunction with a bypass intercooler. The bypass feature is presented as a bypass pathway 150 extending from a position along the primary loop of the refrigerant circuit 10 disposed downstream of the first heat exchanger 13 and upstream of the expansion element 14 to the vapour injection chamber 34 disposed within the compressor 12.

The bypass pathway 150 includes an expansion element 152 and a downstream-arranged intercooler 154. The intercooler 154 is also disposed along the primary loop of the refrigerant circuit 110 at a position intermediate the branching of the bypass pathway 150 and the expansion element 14. The intercooler 154 is accordingly in heat exchange communication with each of the refrigerant flowing through the bypass pathway 150 and the refrigerant flowing through the primary loop of the refrigerant circuit 110 downstream of the branching of the bypass pathway 150. The expansion element 152 may be adjustable to include a variable flow area therethrough for prescribing a desired pressure drop in the refrigerant when passing therethrough, thereby allowing the refrigerant passing through the expansion element 152 to be expanded from a relatively higher temperature liquid state to a relatively lower temperature, lower pressure gaseous state for introduction into the compressor 12. The expansion element 152 may alternatively be representative of a fixed metering orifice used in conjunction with a shut-off valve for preventing undesired flow through the bypass pathway 150, as desired.

The refrigerant passing through the bypass pathway 150 is accordingly expanded within the expansion element 152 before passing through the intercooler 154. The expansion of the bypassed refrigerant results in the refrigerant passing along the bypass pathway 150 and entering the intercooler 154 having a lower temperature than the refrigerant entering the intercooler 154 along the primary loop of the refrigerant circuit 110. The bypassed gaseous refrigerant is thus heated within the intercooler 154 while the refrigerant of the primary loop is cooled within the intercooler 154.

The bypassed refrigerant reaching the vapour injection chamber 34 is at an intermediate injection pressure between the instantaneous suction pressure and the instantaneous discharge pressure of the compressor 12. When injected into the compression space 32, the intermediate injection pressure is still above that instantaneously found within the corresponding compression chamber, hence the refrigerant at the intermediate injection pressure is still able to increase the discharge temperature of the refrigerant in similar fashion to that described with reference to the discharge recirculation feature of the compressor 12, although to a much lesser extent. Operation of the refrigerant circuit 110 to include the injection of the bypassed refrigerant into the compressor 12 accordingly aids in increasing the discharge temperature of the refrigerant within the compressor 12, and hence the temperature of the refrigerant within the downstream arranged first heat exchanger 13. The injection of the bypassed refrigerant may accordingly increase the heating capacity of the first heat exchanger 13 in comparison to operation of the refrigerant circuit 110 absent the injection process.

The cooling of the refrigerant along the primary loop of the refrigerant circuit 110 as experienced within the intercooler 154 also tends to cause the cooling capacity of the second heat exchanger 15 to be increased in comparison to operation of the refrigerant circuit 110 absent the bypassing of the refrigerant through the bypass pathway 150. If the second heat exchanger 15 is arranged an a cabin evaporator of the refrigerant circuit 110, this increased cooling capacity can be used to aid in cooling the air delivered to the passenger cabin or in cooling any heat generating components in heat exchange relationship with the refrigerant circuit 110.

As shown in FIG. 11, the compressor 12 still includes the discharge recirculation pathway 50 for fluidly coupling the discharge chamber 33 to the vapour injection chamber 34. The vapour injection chamber 34 is accordingly in selective fluid communication with each of the discharge chamber 33 via the opening of the flow control valve 52 and the bypass pathway 150 via the opening of the expansion element 152 (or a corresponding shut-off valve if a fixed orifice is utilized).

The configuration of FIG. 11 may be utilized to account for a variety of different modes of operation of the refrigerant circuit 110 and the corresponding compressor 12. For example, the bypass injection feature associated with the bypass pathway 150 may be utilized when it is desired to increase the cooling capacity of the second heat exchanger 15 or when it is desired to impart a relatively low increase in the heating capacity of the first heat exchanger 13 below that possible with use of the discharge recirculation feature. The discharge recirculation feature associated with the discharge recirculation pathway 50 may then be utilized when the bypass injection feature is not able to impart the desired heating capacity to the first heat exchanger 13. The disclosed refrigerant circuit 110 accordingly allows for both a heating and a cooling effect of the refrigerant circuit 100 to be enhanced via use of the compressor 12 having the dual vapour injection features.

The flow control valve 52 and the expansion element 152 may be adjustably controlled to alternate the source of the refrigerant entering the vapour injection chamber 34 depending on the selected mode of operation of the compressor 12 and/or refrigerant circuit 110. It is also conceivable that circumstances may exist wherein the vapour injection chamber 34 is in fluid communication with refrigerant originating from both of the pathways 50, 150, such as utilizing the refrigerant through the discharge recirculation pathway 50 to supplement the flow through the bypass pathway 150 where it is desirable to further increase the heating capacity of the first heat exchanger 13 while maintaining a cooling capacity increase of the second heat exchanger 15, although such an increase in cooling capacity may be limited by the total increase in temperature imparted by the recirculation processes. For example, the flow control valve 52 may be adjusted to ensure that the refrigerant originating from the discharge recirculation pathway 50 has a greater pressure than that originating from the bypass pathway 150 while maintaining a heat exchange relationship at the intercooler 154 wherein the refrigerant flowing towards the second heat exchanger 15 is cooled enough to improve the cooling capacity thereof, despite the increase in temperature imparted to the refrigerant within the compressor 12.

Referring back to embodiment of the compressor 12 shown in FIG. 3, the second portion **34*b* of the vapour injection chamber 34 may be provided in the absence of the illustrated cap to allow the exposed end of the second portion 34*b* to be fluidly coupled to an external fluid line or component such as the bypass pathway 150 disclosed in FIG. 11. The embodiment of the compressor 12 shown in FIGS. 9 and 10 similarly includes the ability to make such a fluid connection via the end of the illustrated second portion 34*b* of the vapour injection chamber 34**. However, it should be apparent that the disclosed flow configurations can be achieved via a different structural relationship without departing from the scope of the present invention.

Figure 12:
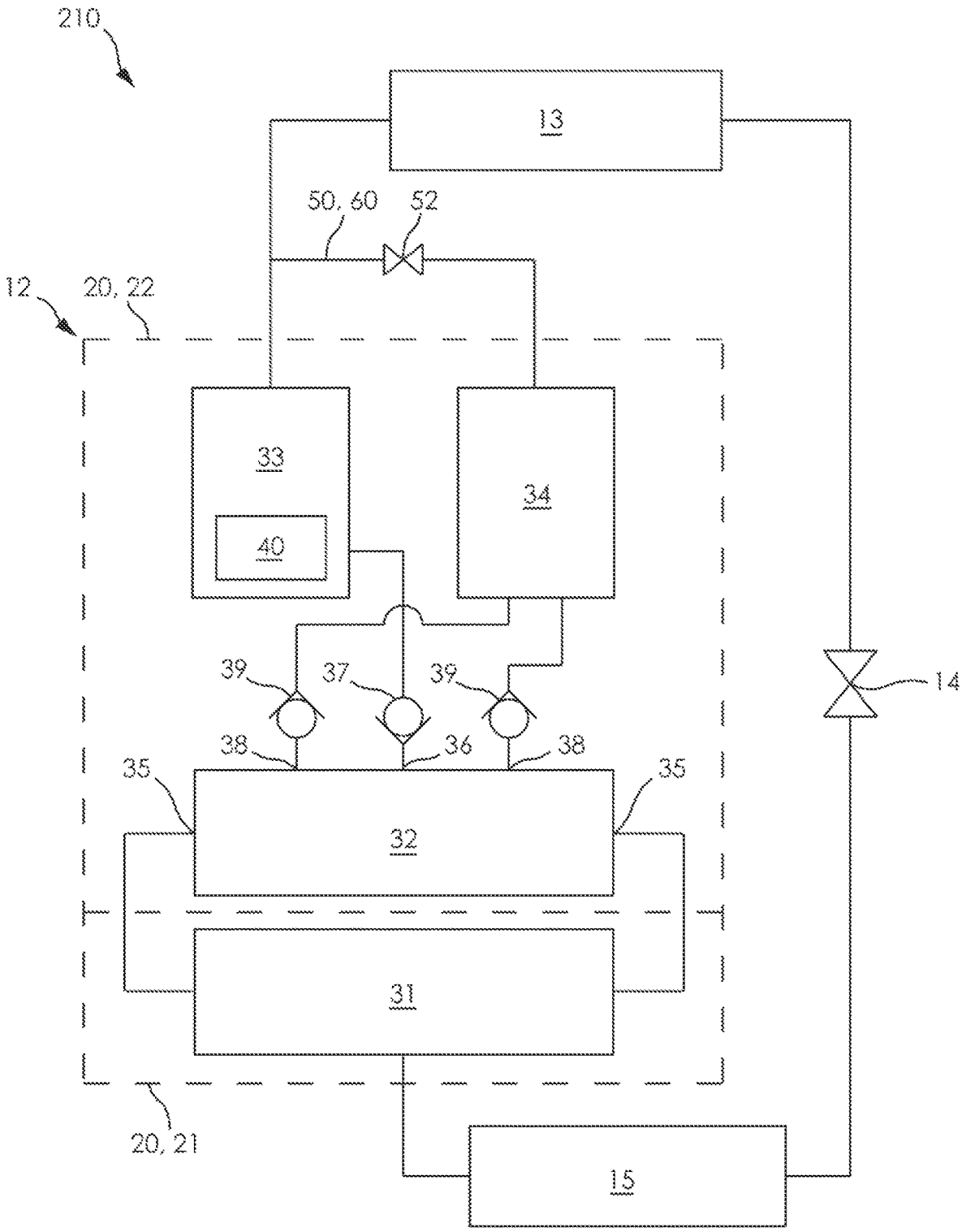
FIG. 12 shows a schematic flow diagram of a refrigerant circuit having a discharge recirculation feature disposed external to a compressor thereof according to another embodiment of the invention.

Referring now to FIG. 12, a refrigerant circuit 210 according to yet another embodiment of the present invention is disclosed. The refrigerant circuit 210 is substantially identical to the refrigerant circuit 10 except for the removal of the discharge recirculation pathway 50 and corresponding flow control valve 52 from a position within the housing 20 of the compressor 12. Instead, the discharge recirculation pathway 50 is provided as an external fluid line 60 extending from a position between the compressor 12 and the first heat exchanger 13 along the refrigerant circuit 210 to the vapour injection chamber 34 of the compressor 12, wherein the external fluid line 60 includes the flow control valve 52 disposed therealong. The external fluid line 60 may be coupled to an end of the second portion **34*b* of the vapour injection chamber 34 in similar fashion to that described above with regards to the bypass pathway 150, as one non-limiting example. The use of the external fluid line 60 having the flow control valve 52 as the discharge recirculation pathway 50 still allows for the increasing of the discharge temperature of the refrigerant, but fails to appreciate the advantages described herein regarding the ability to form a short and direct pathway within the housing 20 in the absence of intervening components and fluid connections. The external fluid line 60 may alternatively be an additional fluid line leading away from the compressor in addition to the fluid line leading towards the first heat exchanger 13, as desired, although such a configuration undesirably requires the addition of a fluid connection to the rear housing 22 of the compressor 12 for communication with the discharge chamber 33**.

The configuration of the compressor 12 as disclosed herein is advantageously capable of being incorporated into existing systems due to the manner in which the introduction of the discharge recirculation pathway 50 and the flow control valve 52 generally requires modification to only the rear housing 22 of an existing compressor 12 otherwise having the configuration of FIG. 1 for performing an injection process. The configuration of the rear housing 22 as shown throughout FIGS. 3-10 is also able to be modified for use in any of the different circuit configurations shown in FIGS. 1, 11, and 12, due to the inclusion of the vapour injection chamber 34 having the ability to be externally fluidly coupled to another component or alternatively capped, depending on the circumstance.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A compressor comprising:

a compression space in which a refrigerant is compressed, the compression space including a discharge port and an injection port;

a discharge chamber fluidly coupled to the compression space by the discharge port;

an injection chamber fluidly coupled to the compression space by the injection port; and a discharge recirculation pathway selectively providing fluid communication between the discharge chamber and the injection chamber, wherein the discharge recirculation pathway directly connects the discharge chamber to the injection chamber.

2. The compressor of claim 1, further comprising a flow control valve disposed along the discharge recirculation pathway for providing the selective fluid communication between the discharge chamber and the injection chamber.

3. The compressor of claim 2, wherein the flow control valve is an adjustable expansion element.

4. The compressor of claim 3, wherein the flow control valve is adjustable to a fully closed position, a fully open position, and a plurality of intermediate positions.

5. The compressor of claim 3, wherein the flow control valve is passively adjustable based on a temperature of the refrigerant within the discharge chamber.

6. The compressor of claim 5, wherein the flow control valve further includes an electronically controlled shut-off feature to prevent fluid communication between the discharge chamber and the injection chamber.

7. The compressor of claim 3, wherein the flow control valve is electronically controlled.

8. The compressor of claim 2, wherein the flow control valve is configured to prevent fluid communication between the discharge chamber and the injection chamber when a temperature of the refrigerant exceeds a threshold value.

9. The compressor of claim 1, wherein the refrigerant is compressed from a suction pressure to a discharge pressure in the compression space, wherein the refrigerant at the discharge pressure enters the discharge chamber through the discharge port, wherein the refrigerant is reduced in pressure from the discharge pressure to an injection pressure intermediate the suction pressure and the discharge pressure when the refrigerant passes through the discharge recirculation pathway, and wherein the refrigerant at the injection pressure is selectively communicated to the compression space through the injection port.

10. The compressor of claim 9, wherein the injection of the refrigerant at the injection pressure into the compression space causes an increase in a temperature of the refrigerant at the discharge port.

11. The compressor of claim 1, wherein the compression space, the discharge chamber, the injection chamber, and the discharge recirculation pathway are all disposed within a housing of the compressor.

12. The compressor of claim 11, wherein the housing is divided into a front housing and a rear housing, wherein the compression space, the discharge chamber, the injection chamber, and the discharge recirculation pathway are all disposed within the rear housing.

13. The compressor of claim 1, wherein the compression space, the discharge chamber, and the injection chamber are all disposed within a housing of the compressor, and wherein the discharge recirculation pathway is a fluid line connecting the discharge chamber to the injection chamber, at least a portion of the fluid line extending outside of the housing.

14. A refrigerant circuit including the compressor of claim 1, the refrigerant circuit further comprising a condenser, a first expansion element, and an evaporator along a primary loop thereof, the refrigerant circuit further comprising a bypass pathway extending from a position between the condenser and the expansion element along the primary loop to the injection chamber of the compressor.

15. The refrigerant circuit of claim 14, wherein the bypass pathway includes a second expansion element and an intercooler, the intercooler in heat exchange relationship with each of the refrigerant passing through the bypass pathway and the refrigerant passing through the primary loop upstream of the expansion element.

16. A method of operating a compressor comprising the steps of:

discharging a refrigerant from a compression space to a discharge chamber, the discharged refrigerant having a discharge pressure;

fluidly communicating the refrigerant disposed within the discharge chamber through a discharge recirculation pathway directly to an injection chamber, the refrigerant having an injection pressure when in the injection chamber, wherein the discharge recirculation pathway directly connects the discharge chamber to the injection chamber; and injecting the refrigerant at the injection pressure into the compression space to increase a pressure and temperature of the refrigerant within the compression space.

17. The method of claim 16, wherein the compression space, the discharge chamber, the injection chamber, and the discharge recirculation pathway are all disposed within a housing of the compressor.

18. The method of claim 16, wherein a flow control valve selectively allows the refrigerant to be fluidly communicated from the discharge chamber to the injection chamber.

19. The method of claim 18, wherein the flow control valve is an adjustable expansion element configured to reduce the pressure of the refrigerant from the discharge pressure to the injection pressure.

20. The method of claim 16, wherein the refrigerant is compressed from a suction pressure to the discharge pressure within the compression space, wherein the injection pressure is intermediate the suction pressure and the discharge pressure.

* * * * *